US005857329A

United States Patent [19]

Bigham

[11] Patent Number: 5,857,329

[45] Date of Patent: Jan. 12, 1999

[54] ONE-PIECE COMBINED MUFFLER EXHAUST OUTLET AND EXHAUST GAS DEFLECTOR

[75] Inventor: Harold Bigham, Matthews, N.C.

[73] Assignee: Deere & Company, Charlotte, N.C.

[21] Appl. No.: 818,521

[22] Filed: Mar. 14, 1997

[51] Int. Cl.[6] ..... F01N 3/02

[52] U.S. Cl. ..... 60/317; 29/890.08; 181/240

[58] Field of Search ..... 60/317, 319, 323; 29/890.08; 181/240

[56] References Cited

U.S. PATENT DOCUMENTS

| | | | |
|---|---|---|---|
| 1,442,196 | 1/1923 | Truelson . | |
| 3,798,769 | 3/1974 | Bailey | 60/311 |
| 3,897,854 | 8/1975 | Rhodes | 181/240 |
| 4,060,985 | 12/1977 | Fukushima | 60/319 |
| 4,142,607 | 3/1979 | Landwehr | 181/240 |
| 4,231,221 | 11/1980 | Mathner et al. | 60/319 |
| 4,370,855 | 2/1983 | Tuggle | 60/317 |
| 4,867,270 | 9/1989 | Wissmann et al. | 181/231 |
| 5,080,048 | 1/1992 | Kudo | 123/41.64 |
| 5,109,949 | 5/1992 | Sato | 181/240 |
| 5,651,249 | 7/1997 | Nagao | 181/240 |

*Primary Examiner*—Thomas E. Denion
*Attorney, Agent, or Firm*—Perman & Green, LLP

[57] ABSTRACT

A power tool having an internal combustion engine with a muffler and a combined muffler exhaust outlet and exhaust gas deflector connected to the muffler. The combined outlet and deflector is a single one-piece member. The one-piece member is connected to the muffler by interlocking capture of a portion of the member by the muffler and attachment of a single fastener between the member and the muffler.

18 Claims, 3 Drawing Sheets

ONE-PIECE COMBINED MUFFLER EXHAUST OUTLET AND EXHAUST GAS DEFLECTOR

BACKGROUND OF THE INVENTION

1. Field of the Invention

The present invention relates to internal combustion engines and, more particularly, to a combined exhaust outlet and exhaust deflector for a muffler.

2. Prior Art

U.S. Pat. No. 4,370,855 discloses a shield mounted on a muffler. U.S. Pat. No. 4,867,270 discloses a jet pipe that mixes cool ambient air with hot gases. The mixed gases are blown out of the front. U.S. Pat. No. 4,231,221 discloses a muffler with a cooling pipe and discharge hoods into the cooling pipe.

SUMMARY OF THE INVENTION

In accordance with one embodiment of the present invention, a power tool is provided comprising an internal combustion engine with a muffler and a combined muffler exhaust outlet and exhaust gas deflector. The combined outlet and deflector is comprised of a single one-piece member that is connected to the muffler by interlocking capture of a portion of the one-piece member by the muffler and attachment of a single fastener between the member and the muffler.

In accordance with another embodiment of the present invention, a power tool muffler assembly is provided comprising a muffler and a combined muffler exhaust outlet and exhaust gas deflector. The combined outlet and deflector is connected to the muffler. The deflector is comprised of a single one-piece member.

In accordance with one method of the present invention, a method of assembling an internal combustion engine muffler assembly is provided comprising steps of providing a combined muffler exhaust outlet and exhaust gas deflector having a first end with a retaining leg; inserting the retaining leg into a mounting aperture of a muffler; attaching a single fastener to the muffler and to a second end of the combined member. The combined outlet and deflector is retained to the muffler only by the single fastener and interlocking engagement between the retaining leg and the muffler.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
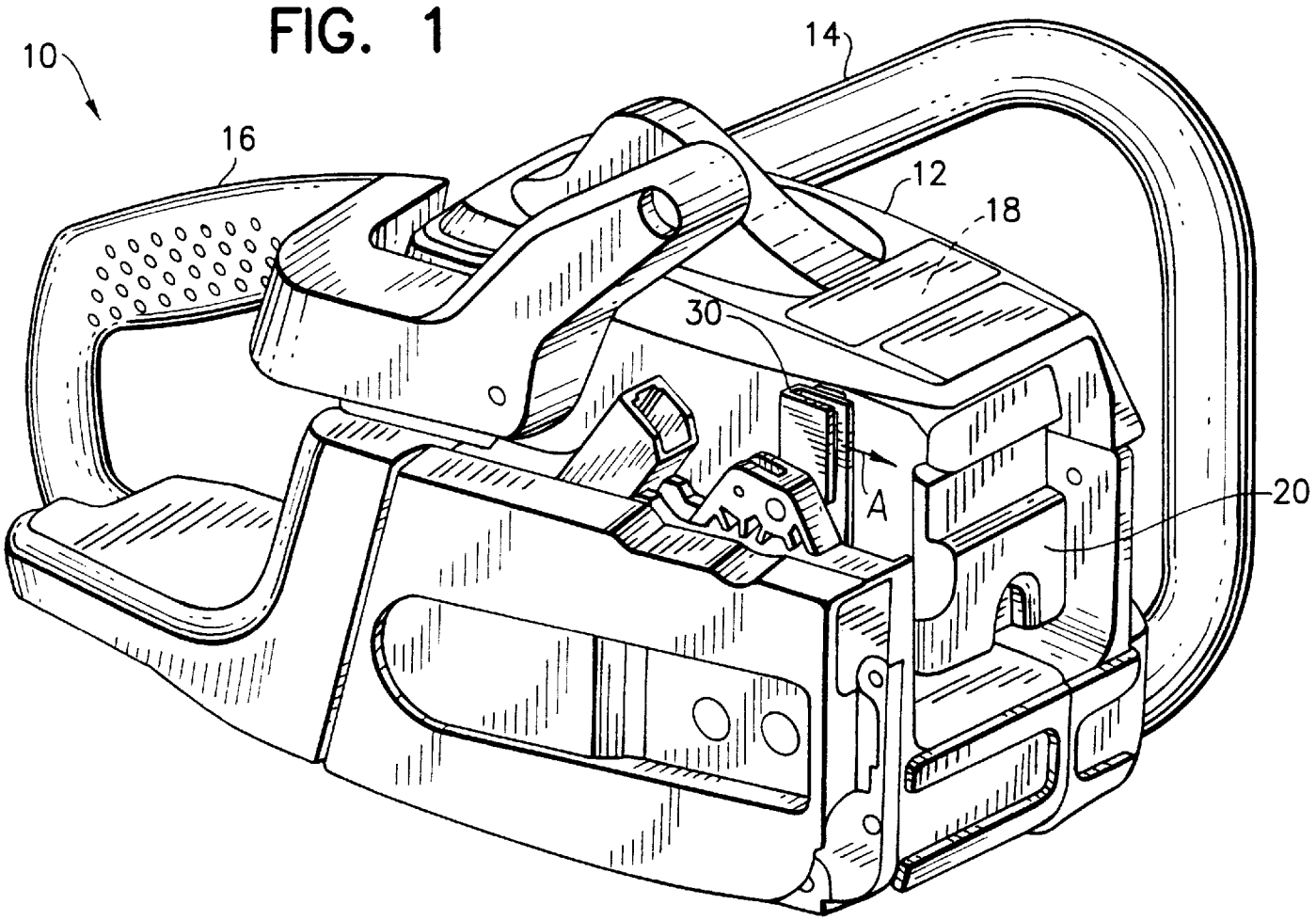
FIG. 1 is a perspective view of a chain saw, without its chain bar and saw chain, incorporating features of the present invention.

Referring to FIG. 1, there is shown a perspective view of a chain saw 10 incorporating features of the present invention. Although the features of the present invention will be described with reference to the embodiments shown in the drawings, it should be understood that features of the present invention can be embodied in many different alternative embodiments including other types of power tools. In addition, any suitable size, shape or type of elements or materials could be used.

Figure 2:
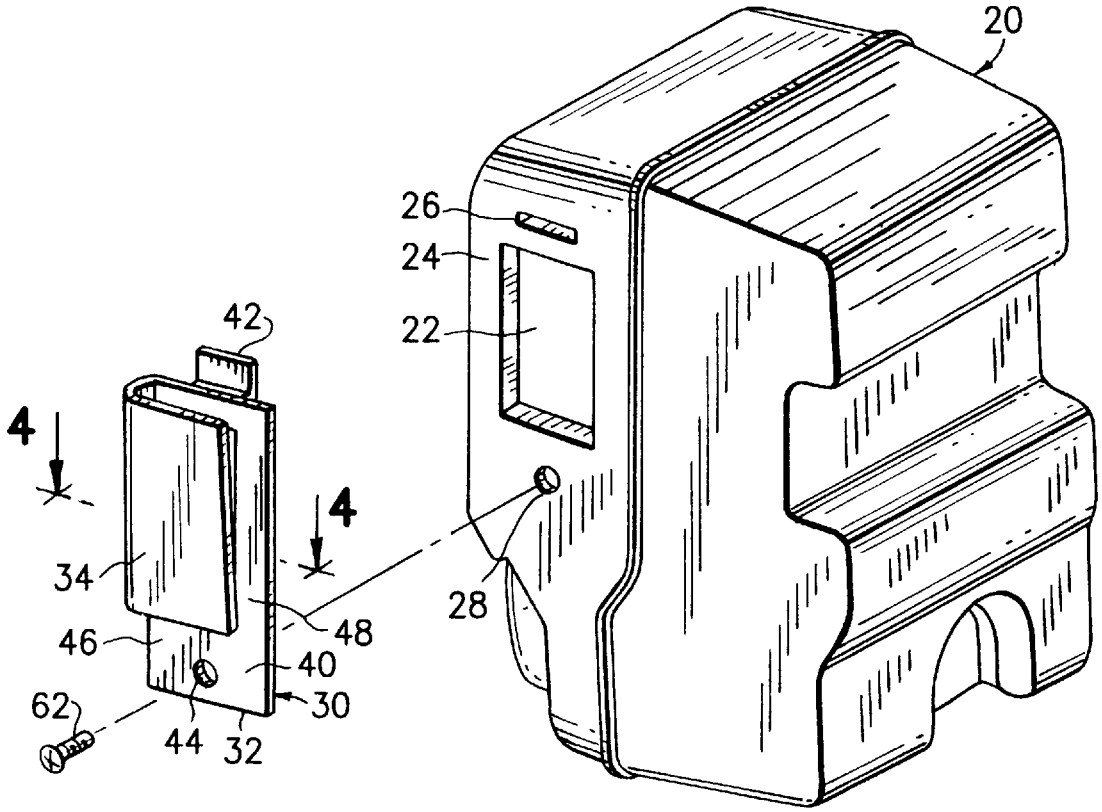
FIG. 2 is a perspective view of the muffler and the combined outlet and deflector shown on the chain saw in FIG. 1.

The chain saw 10 shown in FIG. 1 is shown without its chain bar and saw chain for the sake of better illustration of the invention. In addition to the chain bar and saw chain, the chain saw 10 includes a housing 12, a front handle 14, a rear handle 16 and a motor 18 located in the housing 12. The motor 18 is an internal combustion engine with a muffler 20 located at the front end. Referring also to FIG. 2, the muffler 20 has an port 22 located on its side 24. A slot 26 is located above the port 22. A screw hole 28 is located below the port 22. In alternate embodiments, the slot and/or screw hole could be located at the sides of the port 22 or in reverse orientations.

Figure 3:
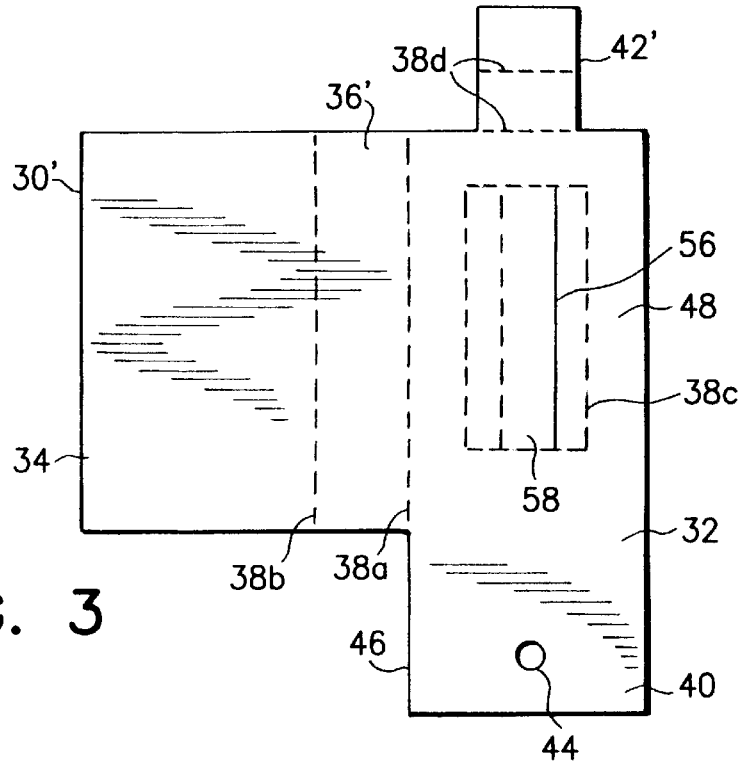
FIG. 3 is a plan view of a flat metal blank used to form the combined outlet and deflector shown in FIG. 2.
Figure 4:
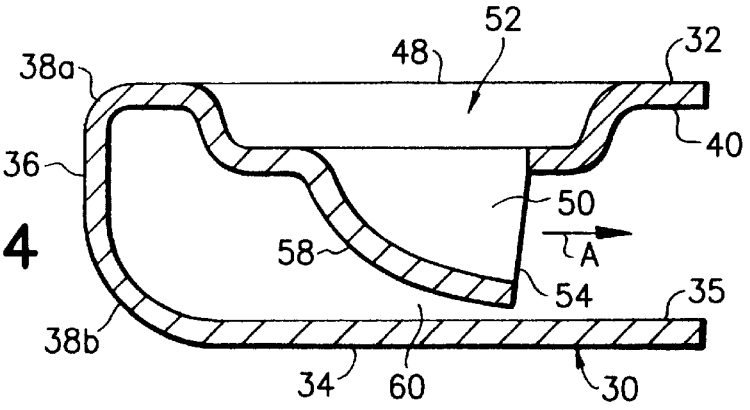
FIG. 4 is a cross-sectional view of the combined outlet and deflector shown in FIG. 2 taken along line 4—4.

Connected to the muffler 20 is a combined muffler exhaust outlet and exhaust gas deflector 30. The combined outlet and deflector 30 is preferably a one-piece member made of metal. However, in alternate embodiments the deflector could be made of multiple members unitarily fixed to each other and/or made of high temperature plastic or polymer materials, such as a molded plastic member. Referring also to FIG. 4, the combined outlet and deflector 30 (hereinafter the "combined member") is comprised of a single flat sheet metal member that is cut and formed into the shape shown. The combined member 30 has a first section 32 and a second section 34. The first section 32 functions as a muffler exhaust outlet. The second section 34 functions as an exhaust gas deflector. The first section 32 covers the port 22 and helps to reduce noise coming from the muffler. The second section 34 guides the hot exhaust gases after they leave the gas outlet path in the first section. Referring also to FIG. 3, a blank 30' of the combined member 30 is shown after the flat sheet metal has been cut, but before its final formation into the combined member 30. The blank 30' is flat. The dotted lines indicate lines of deformation to transform the blank into the combined member. The second section 34 of the combined member 30 is cantilevered off of a side of the first section 32 by an extension 36. Two bends at areas 38*a*, 38*b*, cause the second section 34 to bend around and over an outward side 40 of the first section 32. The first section 32 has an interlock mounting portion 42, a screw hold 44 at a bottom section 46, and a middle section 48. The middle section 48 has an exhaust gas channel 50 with an entrance 52 and an exit 54. The channel 50 is formed by a single cut 56 in the middle section 48 and then outwardly deforming the middle section at areas 38*c*. Section 58 is outwardly deformed the most to form the channel 50. A gap 60 is established between the section 58 and the second section 34. The gap 60 forms a thermal insulating area. The end 35 of the second section 34 extends forward past the end of the exit 54. Thus, the second section 34 forms an extended channel between the end 35 of the second section 34 and the first section 32. This channels the hot exhaust gases past the exit 54 and further away from plastic housing pieces near the port 22. This further prevents the heat from the hot gases from damaging the surrounding components.

The combined member 30 is attached to the muffler 20 merely by interlocking engagement of the mounting portion 42 with the muffler 20 and use of a single fastener. The mounting portion 42' of the blank 30' is bent at areas 38*d* to form a general L-shape. The portion 42 is inserted into the slot 26. The hole 44 is aligned with the hole 28. A screw 62 is then fastened to the combined member 30 and the muffler 20 in the holes 44,28. The entrance 52 is thus aligned over the port 22 from the muffler 20. The interlocking engagement of the portion 42 in the slot 26 and the attachment with the single fastener 62 fixed and stationarily connects the combined member 30 directly on the muffler 20. With this type of formation of the channel 50, the top and bottom of the channel 50 are closed by the section 58. The exhaust gases must travel out the exit 54 to exit the combined member 30 as indicated by arrow A in FIG. 4. In alternate embodiments, multiple fasteners could be used to connect the combined member to the muffler. The combined member could also be spot welded to the muffler. Any suitable type of means to mount the combined member to the muffler could be provided.

Figure 5:
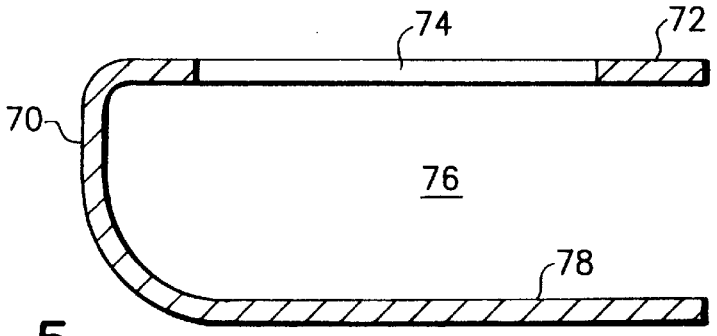
FIG. 5 is a cross-sectional view of an alternative embodiment of the present invention.

With the combined member 30 attached to the muffler 20, and the muffler 20 attached to the engine 18, the channel 50 forms a right hand turn to direct hot exhaust gases towards the front of the chain saw away from the user's hand on the front handle 14 and away from surrounding housing components. This is shown in FIG. 1 by arrow A. In alternate embodiments, other shapes of channels or second sections could be provided. FIG. 5 shows an alternate embodiment of a combined member 70 where the first section 72 merely has an entrance 74. The area 76 between the first section 72 and the second section 78 forms the exhaust gas channel. The area 76 could have a closed top and bottom, such as if the second section had top and bottom tabs that are folded towards the first section or if the combined member 70 was made as an extruded member. Rather than the interlocking mounting portion 42, the portion 42 could be replaced by a mounting hole and second fastener.

As noted above, one of the advantages of the present invention is to direct hot exhaust gases away from the user's hand on the handle 14 and away from components near the port 22. This is done, not by providing an additional member as in old systems, but by forming the deflector section 34 integral with the outlet section 32. Another advantage is that the combined member and its attachment to the muffler are both lightweight and inexpensive to manufacture and assemble. Use of only a single fastener speeds up assembly time and reduces costs. Providing the combined member as a one-piece sheet metal member with an integral interlock mounting portion also keeps added weight low and is relatively inexpensive to manufacture and assemble.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. In a power tool having an internal combustion engine with a muffler, wherein the improvement comprises:

a combined muffler exhaust outlet and exhaust gas deflector connected at an exterior side of the muffler, the combined muffler exhaust outlet and exhaust gas deflector being comprised of a single one-piece member that is connected to the muffler by interlocking capture of a first portion of the member by the muffler and attachment of a single fastener between a second portion of the member and the muffler.

2. In a power tool as in claim 1 wherein the one-piece member is a flat metal member that is cut and formed.

3. In a power tool as in claim 2 wherein the flat metal member has a first section that is cut and deformed outward to form an exhaust gas entrance and channel.

4. In a power tool as in claim 3 wherein the flat metal member has a second section that is bent around over an outward side of the first section.

5. In a power tool as in claim 4 wherein the first portion extends from a first end of the first section and, a second end of the first section forms the second portion with a hole for the fastener to pass through.

6. In a power tool as in claim 1 wherein the one-piece member has a first section with an exhaust gas entrance and an exhaust gas redirection channel.

7. In a power tool as in claim 6 wherein the one-piece member has a second section that bends around to extend over an outer side of the exhaust gas redirection channel.

8. In a power tool as in claim 7 wherein the second section is spaced from the exhaust gas redirection channel of the first section.

9. A power tool muffler assembly comprising:

a muffler; and a combined muffler exhaust outlet and exhaust gas deflector, connected to the muffler, which is comprised of a single one-piece member wherein the one-piece member has an interlock mounting portion that extends from a first end of a first section and a second end of the first section has a hole for a fastener to pass through.

10. An assembly as in claim 9 wherein the one-piece member is a flat metal member that is cut and formed.

11. An assembly as in claim 10 wherein the flat metal member forms the first section that is cut and deformed outward to form an exhaust gas entrance and channel.

12. An assembly as in claim 11 wherein the flat metal member has a second section that is bent around over an outward side of the first section.

13. An assembly as in claim 9 wherein the one-piece member has a first section with an exhaust gas entrance and an exhaust gas redirection channel.

14. An assembly as in claim 13 wherein the one-piece member has a second section that bends around to extend over an outer side of the exhaust gas redirection channel.

15. An assembly as in claim 14 wherein the second section is spaced from the exhaust gas redirection channel of the first section.

16. A method of assembling an internal combustion engine muffler assembly comprising steps of:

providing a combined muffler exhaust outlet and exhaust gas deflector having a first end with a retaining leg;

inserting the retaining leg into a mounting aperture of a muffler; and attaching a single fastener to the muffler and to a second end of the combined outlet and deflector;

wherein the combined outlet and deflector is retained to the muffler only by the single fastener and interlocking engagement between the retaining leg and the muffler.

17. A method as in claim 16 wherein the step of providing a combined outlet and deflector comprises cutting and forming a flat metal member, wherein the combined outlet and deflector is a one-piece member.

18. A method as in claim 17 wherein the flat metal member is cut and deformed to form a first section with an exhaust gas entrance and an exhaust gas redirection channel and, a second section that is bent around and over the first section.

* * * * *